United States Patent [19]

Taga

[11] Patent Number: 4,799,611

[45] Date of Patent: Jan. 24, 1989

[54] APPARATUS FOR ASSEMBLING PAIRS OF GARMENT FASTENER ELEMENTS

[75] Inventor: Yukio Taga, Uozu, Japan

[73] Assignee: Yoshida Kogyo K. K., Tokyo, Japan

[21] Appl. No.: 81,734

[22] Filed: Aug. 5, 1987

[30] Foreign Application Priority Data

Aug. 6, 1986 [JP] Japan ..... 61-184870

[51] Int. Cl.[4] ..... A41H 37/10

[52] U.S. Cl. ..... 227/18; 227/156; 227/119

[58] Field of Search ..... 227/15, 18, 110, 149, 227/156, 119, 43, 115; 29/721

[56] References Cited

U.S. PATENT DOCUMENTS

| | | | |
|---|---|---|---|
| 2,377,263 | 5/1945 | Peterson | 227/18 |
| 2,561,108 | 7/1951 | Gerber | 227/82 |
| 3,750,925 | 8/1973 | Schmidt et al. | 227/18 |
| 3,815,805 | 6/1974 | Beneteau | 227/119 |
| 3,831,250 | 8/1974 | Holiday | 29/721 X |
| 3,964,661 | 6/1976 | Schmidt et al. | 227/18 |
| 4,514,899 | 5/1985 | Burger | 29/721 |
| 4,605,150 | 8/1986 | Ikehara | 227/18 |

FOREIGN PATENT DOCUMENTS

| | | |
|---|---|---|
| 5213943 | 2/1977 | Japan . |
| 60-113329 | 7/1985 | Japan . |

*Primary Examiner*—Paul A. Bell

*Attorney, Agent, or Firm*—Hill, Van Santen, Steadman & Simpson

[57] ABSTRACT

A garment-fastener assembling apparatus includes a combined supporting and connecting mechanism composed of a pivot lever rotatably mounted on a frame and pivotably connected at its one end with the cylinder tube of a punch-driving cylinder and at the other end with a first pusher mechanism having a first pusher, and a spring-biased slide rod slidably mounted on the frame and having one end pivoted to the pivot lever adjacent to the cylinder tube. The slide rod is normally urged such that during a portion of the movement of the piston rod from the cylinder tube adjacent to the fully retracted position of the piston rod, the pivot lever operates the first pusher mechanism to retract and advance the first pusher. With the combined mechanism thus constructed, a punch and the first pusher can be driven in an accurate timed relation to one another. The first pusher mechanism includes a cushioning arrangement for preventing advancing movement of the first pusher if an element-feed passage is jammed by foreign matter. The stroke of a second pusher can be adjusted independently from the stroke of a die by a cam block connected to the piston rod of a die-driving cylinder.

17 Claims, 12 Drawing Sheets

APPARATUS FOR ASSEMBLING PAIRS OF GARMENT FASTENER ELEMENTS

BACKGROUND OF THE INVENTION

1. Field of the Invention

The present invention relates to an apparatus for assembling a pair of fastener elements of a garment fastener, such as a button, a snap button or an ornament, with a garment fabric disposed between the two fastener elements.

2. Prior Art

U.S. Pat. No. 3,964,661, issued June 22, 1976 discloses a fastener-assembling apparatus which includes a first drive mechanism for vertically reciprocating an upper punch of an upper unit, a second drive mechanism for vertically reciprocating a lower punch or die of a lower unit, a first pusher mechanism having an upper pusher reciprocally driven by the first drive mechanism to supply one of a pair of fastener elements to the upper unit, a second pusher mechanism having a lower pusher reciprocally driven by the second drive mechanism to supply the other fastener element to the lower unit, and an indicator fixedly connected to the upper pusher for directing a beam of light to a garment fabric to indicate a position on the garment fabric where the two fastener elements are to be attached. The drive and pusher mechanisms are operatively linked with each other in such a manner that the upper and lower pushers are retracted from the path of movement of the punch and die in response to the movement of the punch and die in a direction toward each other to clinch the two fastener elements together, with the garment fabric sandwiched between the fastener elements.

The known apparatus of the foregoing construction has various drawbacks, as follows:

The first drive mechanism includes a cylinder slidably supported on the frame and operatively connected with the first pusher mechanism. However, there is no direct connection between supporting means and connecting means with the result an accurate timed operation of the first drive mechanism and the first pusher mechanism is difficult to achieve.

Furthermore, the upper pusher of the first pusher mechanism is operatively connected with the cylinder of the first drive mechanism through a pair of pivot levers linked together with a compression coil spring acting therebetween. When a cylinder tube of the cylinder is axially moved in a direction to advance the upper pusher, the spring-biased pivot levers resiliently move the upper pusher forwardly, thereby preventing abrupt supply of the fastener element to the upper unit. The spring-biased levers, however, do not change the direction of power transmission path extending from the cylinder tube to the upper pusher with the result that the upper pusher is forced to advance the fastener element even when foreign matter is present in an element-feed path. With this forcible feeding, the fastener element is likely to be damaged or otherwise deformed.

Another problem is that the cylinder is slidably supported on a block secured to a frame and is urged by a spring against the block. Upon energization and de-energization of the cylinder, the cylinder tube hits against the block, thereby generating objectionable shock noises and vibration.

It is a further drawback of the known apparatus that the lower pusher and the die are reciprocated by a single cylinder via a linkage mechanism. Both the stroke of the lower pusher and the stroke of the die are depending on the stroke of the cylinder and hence a separate stroke adjustment of the lower pusher and the die is difficult to achieve. With this difficulty, a reliable attachment can not be expected when the fastener elements are to be set on garment fabrics varying in thickness.

Another difficulty is that the position indicator is structurally and operatiionally integral with the upper pusher and hence requires a relatively large operating area. The position indicator is retracted from the path of movement of the punch upon actuation of the air cylinder to lower the punch. It is therefore no longer possible for the operator to monitor as to whether the fastener elements are being set on the garment fabric accurately at the desired position. Further, the indicator has a downwardly projecting portion which would catch a garment fabric as the indicator reciprocates in unison with the upper pusher.

A still further problem is that the known apparatus has no means for retaining an upper unit reliably in a position to receive the fastener element from the upper pusher. Rather, the upper unit is likely to be displaced from the element-receiving position when the stroke of the punch is changed while in use.

Furthermore, the prior apparatus requires a tedious and time-consuming operation for removing foreign matter or a jamming fastener element from the feed path, resulting in downtime of the apparatus.

SUMMARY OF THE INVENTION

With the foregoing drawbacks of the prior art in view, a general object of the present invention is to provide a garment-fastener assembling apparatus so constructed as to enable a stable and reliable assembling of a pair of fastener elements of a garment fastener with a garment fabric sandwiched between the two fastener elements.

A more specific object of the present invention is to provide an apparatus having structural features which ensure that a clinching operation and a fastener-element supply operation can be achieved in an accurate timed relation to one another.

Another object of the present invention is to provide a fastener-assembling apparatus which includes a first pusher mechanism so constructed as to protect fastener elements against damage even when foreign matter is present in an element-feed path.

A further object of the present invention is to provide a fastener-assembling apparatus having a shock absorber associated with a drive cylinder for preventing generation of objectionable shock noises and vibration.

A still further object of the present invention is to provide a fastener-assembling apparatus, in which a second pusher mechanism is capable of feeding fastener elements stably even when pairs of fastener elements are to be attached to garment fabrics of different thicknesses.

Another object of the present invention is to provide a fastener-assembling apparatus including an optical position indicator which requires only a limited operating space, does not interfere positioning of a garment fabric with respect to a punch and die assembly, and enables the operator to monitor the setting condition of the garment fabric until the upper unit comes close to the position indicator.

A further object of the present invention is to provide a fastener assembling apparatus having a retainer for holding an upper unit stably and accurately in an element-receiving position.

A still further object of the present invention is to provide a fastener-assembling apparatus including means for removing a foreign matter or a jamming fastener element from an element-feed path.

According to the present invention, a garment-fastener assembling apparatus includes a combined supporting and connecting mechanism for slidably and pivotably supporting a punch-driving, fluid-pressure actuator on a frame and also for operatively connecting the fluid-pressure actuator with a first pusher mechanism having a reciprocable first pusher. The combined mechanism includes a pivot lever rotatably mounted on the frame and pivotably connected at opposite ends to a cylinder tube of the actuator and the first pusher mechanism, and a spring-biased slide rod slidably mounted on the frame and pivotably connected at its one end to the pivot lever adjacent to the cylinder tube, the slide rod being normally urged in a direction such that during a portion of the movement of a piston rod from the cylinder tube adjacent the fully retracted position of the piston rod, the pivot lever operates the first pusher mechanism to retract and advance the first pusher. With the combined supporting and connecting mechanism thus constructed, a punch and the first pusher can be operated in accurate timed relation to one another.

The first pusher mechanism includes a cushioning rod pivoted at its one end to the other end of the pivot lever, a pivotable actuating lever pivoted at its one end to a rear end of the first pusher, a tubular connecting bar pivotably connected at one end to the other end of the actuating lever and loosely receiving the cushioning rod from the other end thereof, a presser member disposed on the cushioning rod and engageable with the other end of the connecting bar, and biasing means disposed in the tubular connecting bar and acting between the connecting bar and the cushioning rod for urging the latter in a direction to keep the presser member in engagement with the other end of the connecting rod. With this first pusher mechanism, a damage-free feeding of one fastener element by the first pusher is achieved even when foreign matter is jamming an element-feed passage.

The spring-biased slide rod includes a flange engageable with the frame to limit movement of the slide rod in one direction. A shock absorber is cooperative with the slide rod to absorb shock noise and vibration when the flange engages the frame. The shock absorber preferably includes a dashpot and a resiliently deformable cushioning ring.

The apparatus also includes a retainer mechanism incorporated in a punch-driving ram and lockingly engageable with an element-supporting holder for retaining an element-supporting portion of the holder in an element-receiving position when the punch is in its uppermost standby position.

A gate unit is supported on the frame and includes a slide block extending along a first feed feed passage along which one fastener is fed. The slide block is movable in a direction parallel to the first feed passage between a first position in which the slide block is disposed in confronting relation to the discharge end of an element-supplying chute so as to define therebetween the first feed passage, and a second position in which the slide block is disposed out of confrontation with the discharge end, the slide block being normally held in the first position. If the first feed passage is jammed by foreign matter or a fastener element, the slide block is brought to the second position to enable removal of the jamming substance.

The apparatus further includes an optical position indicator movably supported by the frame for indicating a position on a garment fabric where two fastener elements are to be attached, and a drive mechanism operatively connected with the position indicator and movable under the control of the first pusher mechanism for reciprocating the position indicator toward and away from the path of movement of the punch in such a manner that retracting movement of the position indicator begins slightly after the start of retracting movement of the first pusher. With the delay in motion thus provided, the stroke of the position indicator is relatively short and an additional period of time is available for monitoring the position setting of the garment until the upper unit comes close to the position indicator.

A drive mechanism for reciprocating a die includes a fluid-pressure actuator having a piston rod. A second pusher mechanism for reciprocating a second pusher includes a cam block connected to the piston rod of the drive mechanism, and a pivot lever urged against a cam surface on the cam block and operatively connected to the second pusher for reciprocating the latter in response to the reciprocating movement of the piston rod. The cam surface is profiled such that during a portion of movement of the piston rod from the actuator adjacent the fully retracted position of the piston rod, the cam surface turns the pivot lever to reciprocate the second pusher, while during a portion of movement of the piston rod from the actuator adjacent the fully extended position of the piston rod, the cam surface does not turn the pivot lever to interrupt reciprocating movement of the second pusher. With the cam block thus constructed, the stroke of the second pusher is independent from the stroke of a die and hence a proper clinching of the two fastener elements can be achieved even when the garment fabric varies in thickness.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
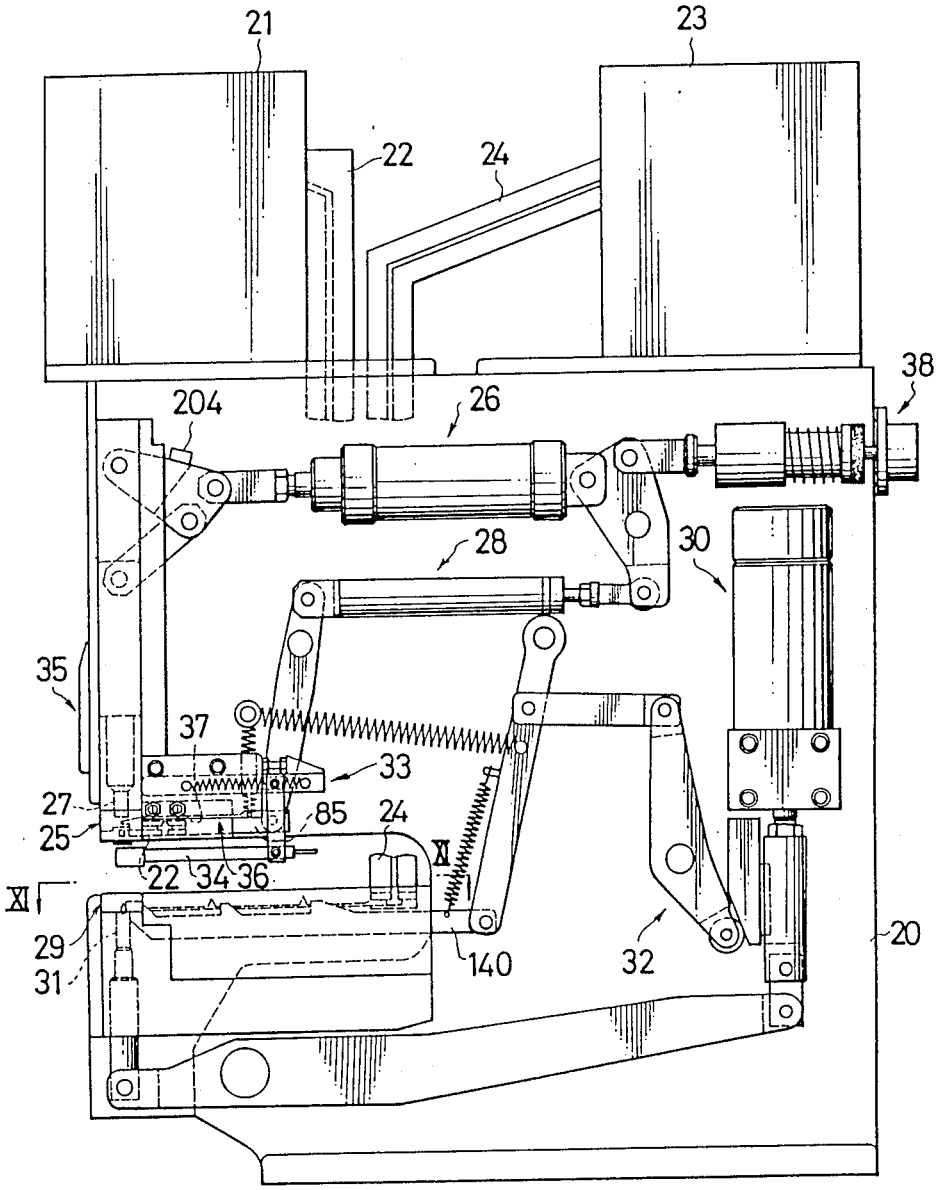
FIG. 1 is a schematic front elevational view showing the general construction of a fastener-assembling apparatus embodying the present invention.

FIG. 1 shows a fastener-assembling apparatus embodying the present invention. The apparatus includes a generally C-shaped support or frame 20 vertically mounted on a table (not shown), the frame having a substantially L-shaped cross-section.

The apparatus comprises a first parts feeder 21 supported on an upper end of the frame 20 for supplying first fastener elements A (FIG. 2) in succession to a first chute 22, and a second parts feeder 23 supported on the frame 20 in tandem relation to the first parts feeder 21 for supplying second fastener elements B (FIG. 2) in succession to a second chute 24.

The apparatus further includes an upper or punch unit 25 disposed below the parts feeder 21, a first drive mechanism 26 for vertically reciprocating a punch 27 of the upper unit 25, a first pusher mechanism 28 for receiving a first fastener element A from the first chute 21 and for supplying the first fastener element A to the upper unit 25, a lower or die unit 29 disposed below the upper unit 25, a second drive mechanism 30 for vertically reciprocating a die 31 of the lower unit 29, and a second pusher mechanism 32 for receiving a second fastener element B from the second chute 24 and for supplying the second fastener element B to the lower unit 25.

The apparatus also comprises a third drive mechanism 33 for reciprocating an optical position indicator 34, a retainer mechanism 35 associated with the upper unit 25, a gate unit 36 associated with the upper unit 25 for opening and closing a feed passage 37 for the first fastener elements A, and a shock absorber 38 associated with the first drive mechanism 26.

Figure 2:
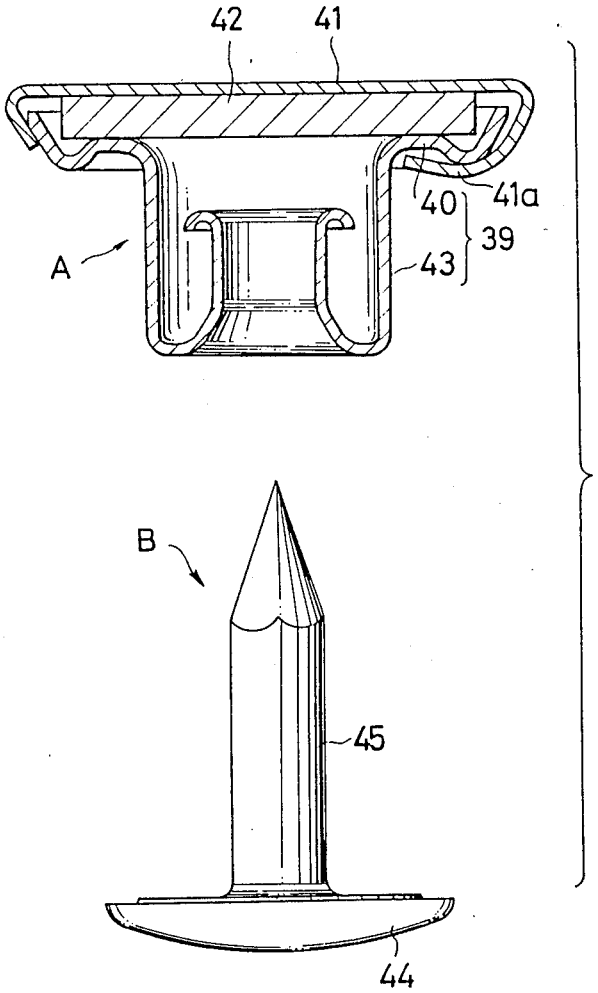
FIG. 2 is a front elevational view, partly in cross section, of a pair of fastener elements to be joined together by the apparatus shown in FIG. 1.

As shown in FIG. 2, the first and second fastener elements A, B comprise a button body and a tack, respectively, of a button. The button body A includes a button back 39 which has an annular rim 40 covered by a cap 41 with a circular back plate 42 disposed between the button back 39 and the cap 41. The cap 41 has a tongue 41*a* underlying the rim 40. The button back 39 also has a hollow shank 43 in the from of a double tube projecting centrally from an inner edge of the annular rim 40. The tack B has a disc-like head 44 and a spike 45 projecting centrally from the head 44 for being forced through a garment fabric C (FIG. 15) into the hollow shank 43 of the button back 39.

Figure 3:
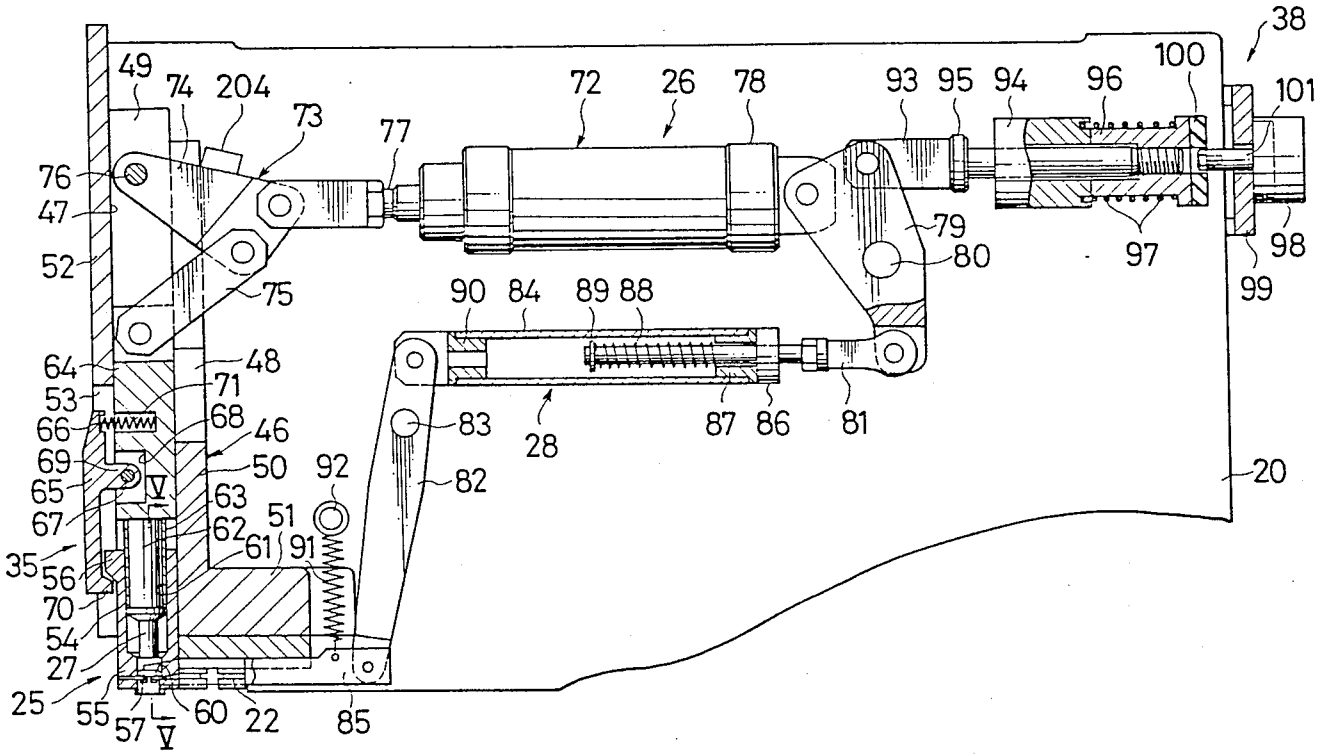
FIG. 3 is an enlarged front elevational view, partly in cross section, of an upper part of the apparatus of FIG. 1.

The upper unit 25, as shown in FIG. 3, includes a guide block 46 secured to the frame 20 and having a vertical guide channel 47 extending longitudinally therethrough, and a vertical slot 48 opening to the guide channel 47. The guide block 46 has a generally L-shape and includes a pair of spaced front and rear walls 49 (only one being shown) extending parallel to the frame 20, a side wall 50 joining the front and rear walls 49 along one edge thereof, and an elongate base 51 projecting perpendicularly from a lower end of the side wall 50. The guide channel 47 is defined by and between the walls 49, 50 and the slot 48 extends from the upper end to an intermediate portion of the side wall 50. The upper unit 25 further includes an elongate cover plate 52 secured to the front and rear walls 49 to close the guide channel 47 from a direction opposite to the side wall 50. The cover plate 52 has a vertical slot 53 extending longitudinally from a lower end to an intermediate portion of the cover plate 52.

The upper unit 25 further includes a tubular holder 54 slidably received in the guide channel 47 in the guide block 46, the block 54 having a lower head portion 55 projecting outwardly downwardly from the guide channel 47. The holder 54 includes an abutment 56 projecting outwardly from an upper end thereof and received in the slot 53 in the cover plate 52.

Figure 4:
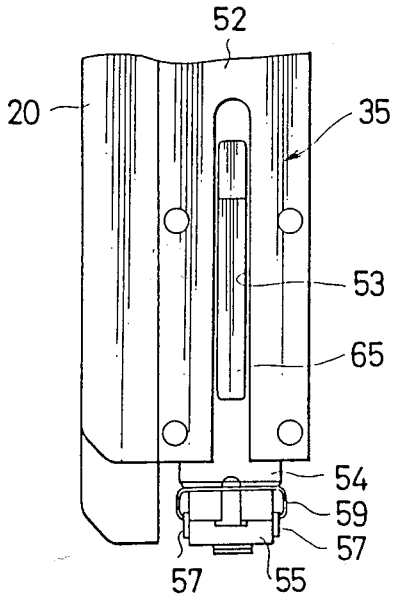
FIG. 4 is an enlarged left side view of a portion of FIG. 3.
Figure 5:
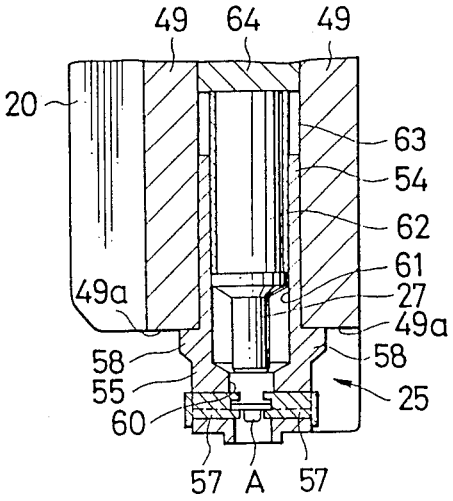
FIG. 5 is an enlarged cross-sectional view taken along line V—V FIG. 3.

As shown in FIG. 5, the holder 54 has a pair of clamp fingers 57, 57 slidably mounted in the head portion 55, and a pair of stop shoulders 58, 58 formed immediately above the head portion 55 and projecting laterally outwardly away from one another. The stop shoulders 58, 58 are engageable with lower ends 49*a*, 49*a* of the respective walls 49. The clamp fingers 57, 57 are urged toward each other by a pair of torsion springs 59 (only one shown in FIG. 4) for holding a button body A below the punch 27 when the button body A is supplied from the first pusher mechanism 28 to clamp fingers 57, 57. When the punch 27 is lowered, the clamp fingers 57 are disposed away from each other against the force of the springs 59 to thereby release the button body A.

The holder 54 further has a vertical hole 60 extending through the head portion 55 for the passage of the punch 27, and a concentric bore 61 of a large diameter extending contiguously upwardly from the hole 60. The clamp fingers 57 normally project in part into the hole 60. The punch 27 is detachably connected to the lower end of a cylindrical plunger or ram rod 62 slidably received in the bore 61 in the holder 54, together with a split bush 63 fitted around the ram rod 62. The ram rod 62 is integral with the lower end of a ram 64 slidably received in the guide channel 47 in the guide block 46, the ram rod 62 having a length smaller than the length of the bore 61. The split bush 63 has the same length of the ram rod 62 and is secured to the ram rod 62. The split bush 63 has a certain degree of radial resiliency so that it frictionally interconnects the holder 54 with the ram rod 62 for limited vertical movement therewith. The ram 64 is vertically reciprocated by the first drive mechanism 26 described below. While the ram 64 is at rest in an uppermost standby position, the ram 64 is vertically spaced from the holder 54 by a distance which is equal to the downward stroke of the punch 27. In this instance, the stopper shoulders 58 are held in contact with the lower ends 49*a* of the front and rear walls 49 of the guide block 46. During the downward stroke of the ram 64 for clinching the button body A and the tack B, the holder 54 is lowered along with the punch 27 until it engages the lower unit 29. Then the ram 64 further moves downwardly until it engages an upper end of the holder 54 during which time the punch 27 is lowered along the hole 60. When the ram 64 arrives at its lowermost position, the lower end face of the punch 27 lies flush with the lower end face of the holder 54.

The retainer mechanism 35, as shown in FIG. 3, is incorporated in the ram 64 and includes an elongate hook 65 and a compression coil spring 66. The hook 65 is movably received in the slot 53 in the cover plate 52 and is pivotably connected to the ram 64 by a pin 67 extending horizontally across a recess 68 in the ram 64 in which a central lateral projection 69 of the hook 65 is loosely received. The hook 65 has at its lower end a locking projection 70 lockingly engageable with the abutment 56 on the holder 54 to hold an element-receiving space between the clamp fingers 57 in horizontal alignment with the element-feed passage 37 while the ram 64 is at rest in the uppermost standby position. The compression coil spring 66 is received in a blind hole 71 in the ram 64 and acts between the ram 64 and the upper end of the hook 65 to urge the hook 65 to turn counterclockwise in FIG. 3.

Figure 15:
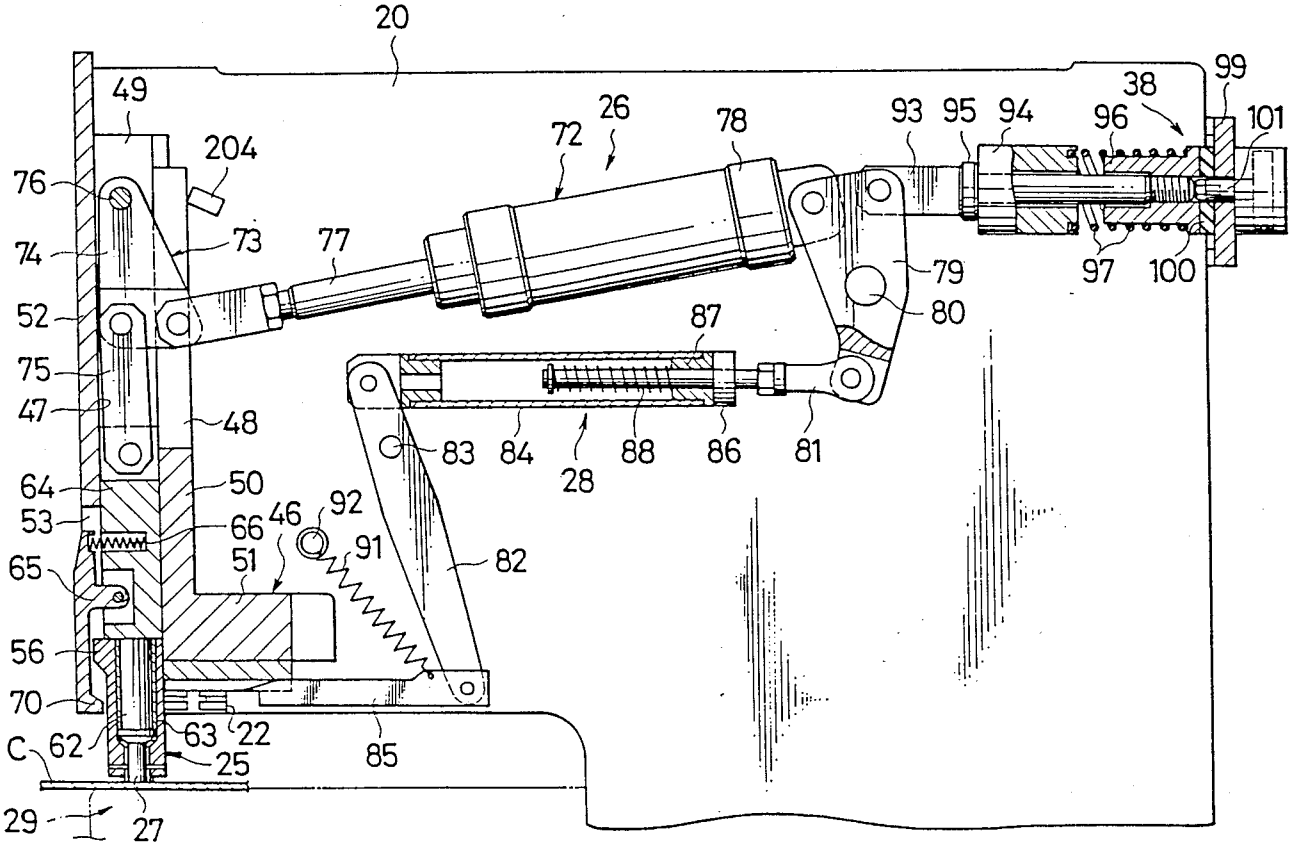
FIGS. 15 and 16 are views similar to FIGS. 3 and 10, respectively, but showing the structural components in a different mode of operation.

The first drive mechanism 26 includes a fluid-pressure actuator such as an air cylinder 72 and a toggle joint 73 composed of a pair of first and second levers 74, 75. The first lever 74 is pivotably connected at its one end to the guide block 46 by a horizontal shaft 76 extending between the front and rear walls 49 of the guide block 46, the other end of the first lever 74 being pivotably connected to a piston rod 77 of the air cylinder 72. The second lever 75 is pivotably connected at opposite ends to the first lever 74 and the upper end of the ram 64. For connection, the levers 74, 75 extend into the vertical bore 47 through the vertical slot 48 in the guide block 46. The air cylinder 72 includes a cylinder tube 78 pivotably connected to one end of a pivot lever 79 rotatably supported on the frame 20 by a horizontal shaft 80, so that the air cylinder 72 is pivotably supported by and between the toggle joint 73 and the pivot lever 79. In response to reciprocating movement of the piston rod 77, the first and second levers 74, 75 are pivotably moved relative to each other between a contracted position in which the two levers 74, 75 are disposed substantially at a right angle to one another (FIG. 3), and an extended position in which the two levers 74, 75 are disposed substantially in a vertical straight line (FIG. 15). Thus, as the two levers 74, 75 are moved between the contracted and extended positions, the ram 64 and hence the punch 27 is moved vertically between the uppermost standby position and a lowermost clinching position.

The first pusher mechanism 28 includes a cushioning rod 81 pivotably connected at its one end to the other end of the pivot lever 79, an actuating lever 82 pivotably supported on the frame 20 by a shaft 83, a tubular connecting bar 84 operatively interconnecting the cushioning rod 81 and one end of the actuating lever 82, and an upper pusher 85 pivotably connected at its rear end to the other end of the actuating lever 82 and slidably supported by the guide block 46. The cushioning rod 81 has a presser member 86 in the form of an annular disc fixedly connected to the rod 81 at an intermediate portion thereof. The presser member 86 may be integrally with the cushioning rod 81. A portion of the cushioning rod 81 extending between the free end of the rod 81 and the presser member 86 is received in the tubular connecting bar 84 and slidably supported by an annular end bush 87 fitted to one end of the connecting bar 84. A compression coil spring 88 is disposed around the cushioning rod 81 and acts between the end bush 87 and a stop ring 89 secured to the free end of the rod 81 so as to urge the cushioning rod 81 leftwardly in FIG. 3 until the presser member 86 engages the end bush 87. The other end of the tubular connecting bar 84 is closed by an end cap 90 to which the actuating lever 82 is pivoted. The upper pusher 85 is urged upwardly by a tension coil spring 91 acting between the upper pusher 85 and a horizontal pin 92 secured to the frame 20. In response to retracting movement (rightward direction in FIG. 3) of the cylinder tube 78, the pivot lever 79 is turned clockwise about the shaft 80 to cause the pressure member 86 to positively move the connecting bar 84 leftwardly. Thus, the actuating lever 82 is turned counterclockwise about the shaft 83 to thereby retract the upper pusher 85 away from the clamp fingers 87. Conversely, the upper pusher 85 is advanced in response to angular movement of the pivot lever 79 in the counterclockwise direction which is caused by the forward movement (leftward direction in FIG. 3) of the cylinder tube 78.

The rearward movement of the cylinder tube 78 is limited by a slide rod 93 slidably supported on a block 94 secured to the frame 20. One end of the slide rod 93 is pivotably connected to one end of the pivot lever 79 adjacent to the cylinder tube 78, and the other end of the slide rod 93 is externally threaded and projects from the block 94, as shown in FIG. 3. The slide rod 93 has an enlarged annular flange 95 disposed between the pivot lever 79 and the block 94, the flange 95 being engageable with the block 94 to limit rearward movement of the cylinder tube 78. An annular spring retainer 96 is threaded to the other end of the slide rod 93. A compression coil spring 97 is disposed around the spring retainer 96 and acting between the block 94 and the retainer 96 to urge the slide rod 93 rightwardly. The spring 97 biases the slide rod 93 and hence the air cylinder 72 such that during a portion of the movement of the piston rod 77 from the cylinder tube 78 adjacent the fully retracted position of the piston rod 77. The pivot lever 79 operates the linked components 81, 82, 84 to retract and advance the upper pusher 85. In response to reciprocating movement of the piston rod 77, the flange 95 and the retainer 96 alternately engage the block 94. Thus the pivot lever 79 and the spring-biased slide rod 93 jointly constitute a combined supporting and connecting mechanism for slidably and pivotably supporting the air cylinder 72 on the frame 20 and also for operatively connecting the air cylinder 72 and the first pusher mechanism 20.

The shock absorber 38 is disposed adjacent to the spring retainer 96 and includes a dashpot 98 supported on a bracket 99, and an annular cushion ring 100 attached to one end face of the spring retainer 96 in confronting relation to the bracket 99. The dashpot 98 has a piston rod 101 extending through the bracket 99 in alignment with the slide rod 93. The piston rod 101 is normally held in an extended position, such as shown in FIG. 3 and, upon engagement with the slide rod 93, it is retractable to dampen and control a motion of the slide rod 93 in such a manner that the flange 95 can be brought into contact with the block 94 without generating shock noises and vibration. The cushion ring 100 is made of a resiliently deformable material such as synthetic resin or rubber foam and is engageable with the bracket 99 slightly before the engagement of the flange 95 with the block 94.

Figure 6:
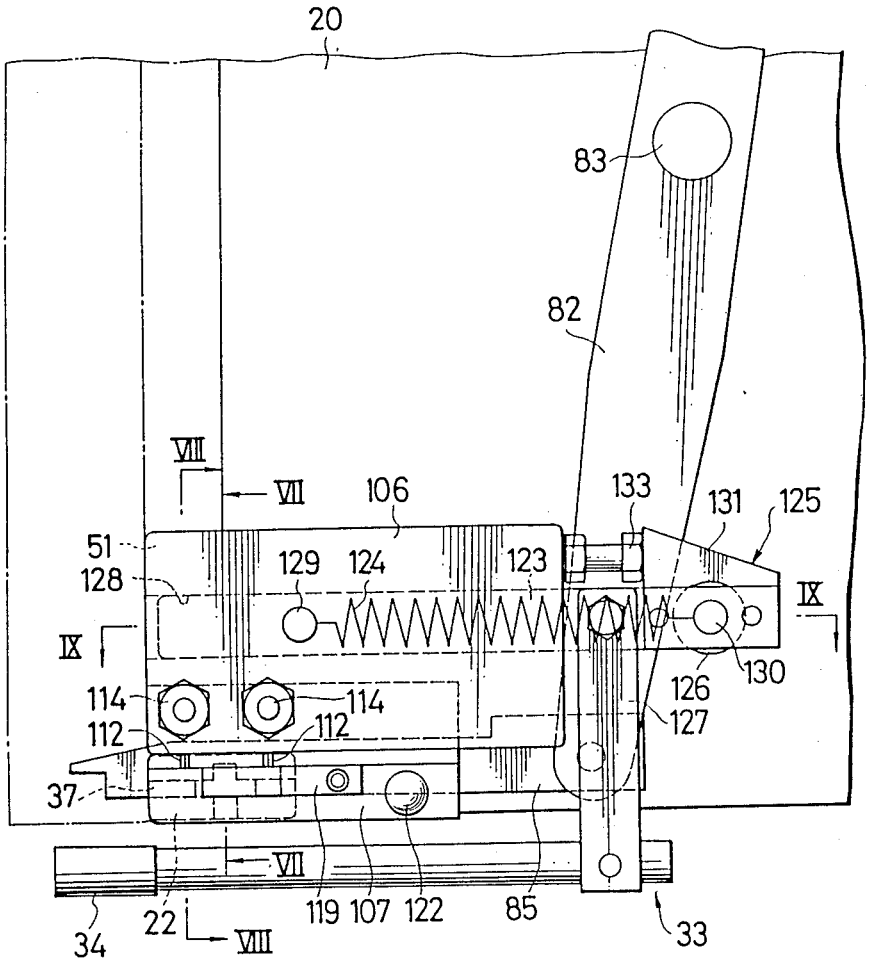
FIG. 6 is an enlarged front elevational view of a portion of the upper part shown in FIG. 3, illustrating a position-indicator driving mechanism and a gate unit.
Figure 7:
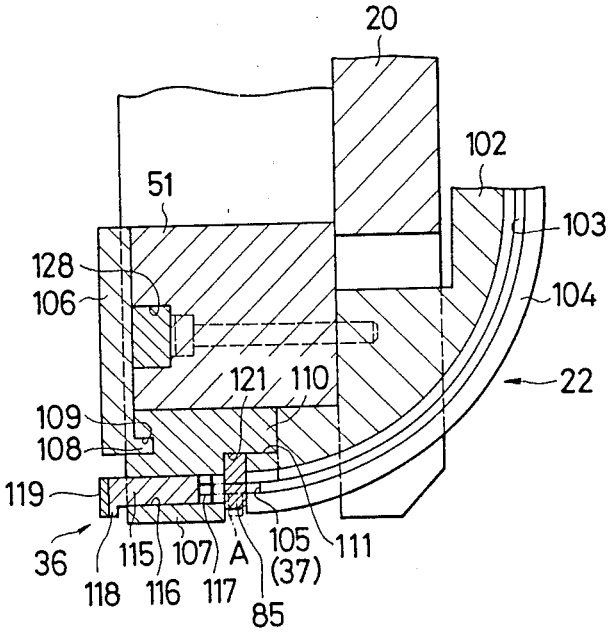
FIG. 7 is a cross-sectional view taken along line VII—VII of FIG. 6.

As shown in FIGS. 6 through 9, inclusive, a lower portion of the first chute 22, the third drive mechanism 33 and the gate unit 36 are disposed adjacent to the base 51 of the guide block 46. The lower portion of the chute 22 extends from the rear side of the frame 20 to a position beneath the base 51 (FIG. 7) and has a discharge end disposed in registry with the element-receiving space between the clamp fingers 57 when the holder 54 is held in the position of FIG. 5. The chute 22, as shown in FIG. 7, includes a chute body 102 having a longitudinal guide groove 103 defined therein for the passage of the button body A, and a pair of L-shaped cover plates 104 attached to the body 102 to partly close a lower open side of the guide groove 103 for preventing displacement of the button body A from the chute body 102. The chute body 102 is secured to the base 51 of the guide block 46. The button body A, as it slides down along the guide groove 103, takes the posture of FIG. 2, in which the hollow shank 43 is facing downwardly. The discharge end of the chute 22 has a retaining groove 105 extending transversely to the guide groove 103 for temporarily holding therein the button body A. The retaining groove 105 constitutes with a portion of the element-feed passage 37.

Figure 8:
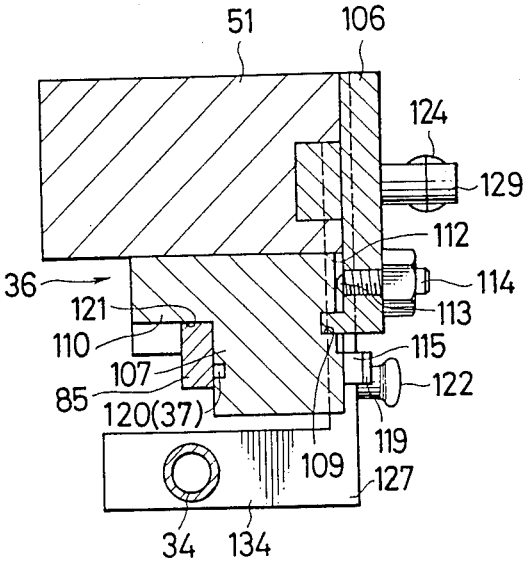
FIG. 8 is a cross-sectional view taken along line VIII—VIII of FIG. 6.
Figure 9:
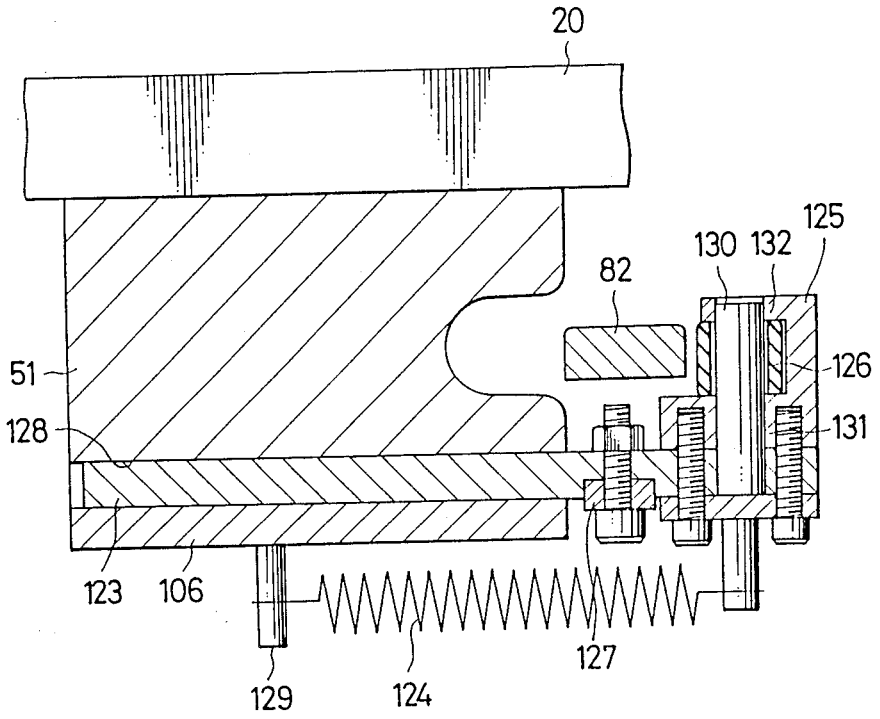
FIG. 9 is a cross-sectional view taken along line IX—IX of FIG. 6.

The gate unit 36 includes a rectangular guide plate 106 having substantially the same length as the base 51, and a rectangular slide block 107 having a length smaller than the length of the base 51. The guide block 106 is secured to a front wall of the base 51 remote from the frame 20 (FIG. 7) and includes a horizontal guide ridge 108 extending along a lower longitudinal edge of the guide block 106 in parallel spaced relation to a lower wall of the base 51. The slide block 107 has a generally L-shape and is disposed below the base 51 in confronting relation to the discharge end of the chute 22. The slide block 107 has, throughout the length thereof, a horizontal guide recess 109 slidably fitted with the guide ridge 108 on the guide block 106, and a lateral projection 110 slidably fitted with a guide step 111 formed in the chute body 102. Thus, the slide block 107 is slidable in a direction parallel to the feed passage 37. As shown in FIGS. 6 and 8, the slide block 107 has a pair of parallel spaced vertical grooves 112 extending transversely to the guide recess 109. The grooves 112 receive therein a pair of spring-loaded balls 113, respectively, movably retained on a tubular holders 114 threaded to the guide plate 106. The spring-biased balls 113 and the grooves 112 jointly constitute a detent assembly for positioning the slide block 107 with respect to the guide plate 106 and the chute 22. As shown in FIG. 7, the gate unit 36 also includes a retainer finger 115 slidably received in a horizontal slot 116 extending transversely through the slide block 107 in alignment with the discharge end of the chute 22. The retainer finger 115 has a retaining recess 117 defined in an inner end face thereof and a stop lug 118 projecting laterally from the outer end of the retainer finger 115. The retaining recess 117 is complementary in contour to the guide groove 103 in the chute 22. The retainer finger 115 is normally urged toward the chute 22 by means of a leaf spring 119 until the stop lug 118 engages the slide block 107. Under such condition, one button body A is stably receivable in the retaining recess 117 in the retainer finger 115 and the retaining groove 105 in the chute 22. Although not shown, the inner end of the retainer finger 115 has a bevelled cam surface engageable with a front end of the upper pusher 85 to retract the retainer finger 115 against the force of the leaf spring 119 when the upper pusher 81 is advanced. The slide block 107, throughout the length thereof, has a horizontal groove 120 (FIG. 8) opening toward the retaining groove 105 in the chute 22 and communicating at one end with the retaining recess 117 in the retainer finger 116, the groove 120 constituting a part of the element-feed passage 37. The slide block 107 further has a horizontal guide channel 121 extending longitudinally for the passage of the upper pusher 85, the guide channel 121 opening downwardly. To move the slide block 107 relative to the guide plate 106, a knob 122 is attached to the slide block 107.

The third drive mechanism 33, as shown in FIG. 6, includes a slide bar 123, a tension coil spring 124, a retainer block 125, a follower member 126, and a support lever 127. The slide bar 123 is slidably received in a horizontal guide groove 128 extending longitudinally in the base 51 and has one end projecting from the guide groove 128. The tension coil spring 124 extends between a first retainer pin 129 secured to the guide plate 106 and a second retainer pin 130 secured to the exposed end of the slide bar 123, and urges the slide bar 123 toward the punch 27 (FIG. 3). The retainer block 125 is of a generally channel shape having a pair of parallel spaced legs 131, 132, one of which is fastened to the exposed end of the slide bar 123. The second retainer pin 130 extends through the slide bar 123 and through the legs 131, 132 across a space defined between the legs 131, 132. The follower member 126 comprising a roller of synthetic rubber is rotatably mounted on a portion of the retainer pin 130 extending between the legs 131, 132. The roller follower 126 is disposed in confronting relation to the actuating lever 82 with a space leaving therebetween. The leg 131 of the retainer block 125 has an upper extension normally held in contact with a stopper bolt 133 threaded to the base 51. The stopper bolt 133 is axially movable to adjust the distance between the actuating lever 82 and the roller follower 126. The support lever 127 has an L-shape and is connected at its one end to the slide bar 123 at a position between the base 51 and the retainer block 125. The support lever 127 has a support arm 134 extending from the other end of the lever 127 toward the frame 20. The optical position indicator 34 is mounted on the support arm 134 in such a manner that it can issue a light beam extending in alignment with the path of movement of the punch 27 when the slide lever 123 is in the position of FIG. 6.

Figure 10:
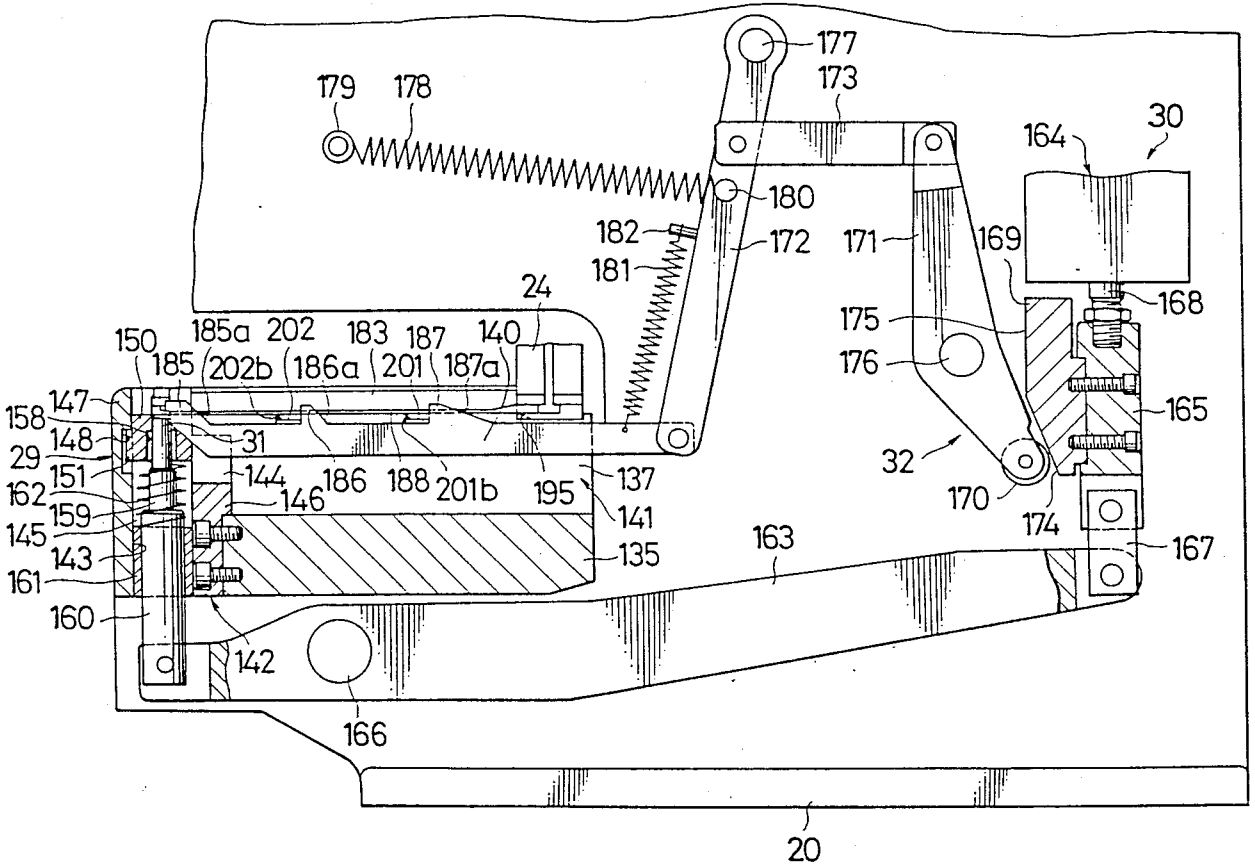
FIG. 10 is an enlarged front elevational view, partly in cross section, of a lower part of the apparatus shown in FIG. 1.
Figure 12:
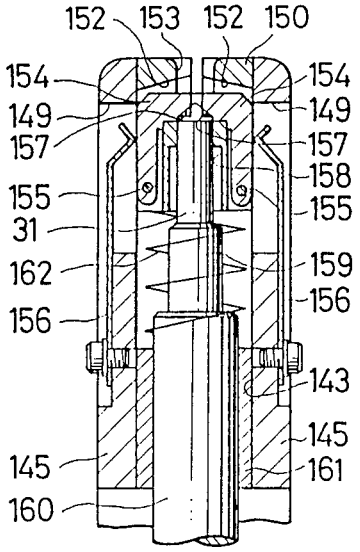
FIG. 12 is a cross-sectional view taken along line XII—XII of FIG. 11.
Figure 13:
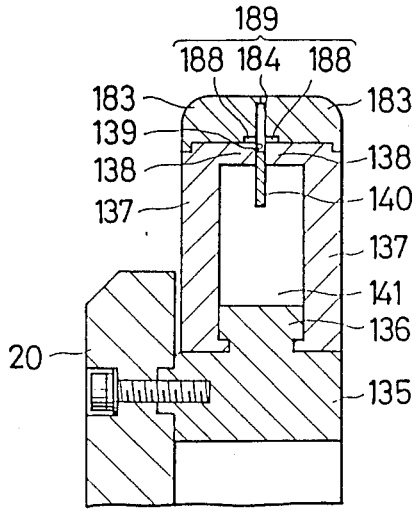
FIG. 13 is a cross-sectional view taken along line XIII—XIII of FIG. 11.

As shown in FIGS. 10 and 13, the lower unit 29 includes an elongate guide base 135 fixedly supported by the frame 20. The guide base 135 has a T-shaped longitudinal guide rib 136 extending on an upper surface thereof for retaining a pair of parallel guide plates 137, 137. Each of the guide plates 137 has a horizontal projection 138 extending along an upper longitudinal edge thereof and projecting toward the projection 138 on the opposite guide plate 137. The two projections 138 are spaced from one another by a slot 139 in and along which a lower pusher 140 of the second pusher mechanism 32 is movable, the slot 139 opening to a hollow space 141 defined between the guide plates 137. Connected to one end (left end in FIG. 10) of the guide base 135 is a guide block 142 having a vertical guide channel 143 extending longitudinally therethrough, and a vertical slot 144 opening to the guide channel 143 for the passage of the lower pusher 140. The guide block 142 includes a pair of spaced front and rear walls 145 (only one shown) extending parallel to the frame 20, and a side wall 146 joining the front and rear walls 145 along one longitudinal edge thereof. The side wall 46 includes a lower portion secured to the guide base 135, and an upper portion in which the vertical slot 144 is formed. The guide channel 143 is defined jointly by and between the walls 145, 146. The lower unit 29 further includes a cover plate 147 secured to the front and rear walls 145 to close the guide channel 143 from a direction opposite to the side wall 146. The cover plate 147 has a vertical recess 148 opening to the guide channel 143. As shown in FIG. 12, the front and rear walls 145 have a pair of aligned oblong holes 149, 149, respectively, extending along upper portions of the respective walls 145 and communicating with the guide channel 143.

The lower unit 29 further includes a tubular holder 150 slidably fitted over the die 31. The holder 150 is slidably received in the guide channel 143 and vertically movable with respect to the guide block 142 for a limited distance which is determined by the stroke of a lateral projection 151 (FIG. 10) on the holder 150 slidably received in the vertical recess 148 in the cover plate 147. The holder 150 has a pair of inverted L-shaped recesses 152, 152 defined in its outer peripheral surface in registry with the oblong holes 149, 149, each recess 152 having an upper end opening to a vertical hole 153 in the holder 150. A pair of inverted L-shaped clamp fingers 154, 154 is received in the respective recesses 152 and they are pivoted at their lower ends to the holder 150 by means of a pair of pins 155, 155. The clamp fingers 154 are urged toward each other by a pair of leaf springs 156, 156 for holding a tack B above the die 31 when the tack B is supplied from the lower pusher 140 to the holder 150. The leaf springs 156 are secured at their lower ends to the respective walls 145 of the guide block 142, the other ends of the springs 156 acting on the clamp fingers 154. The clamp fingers 154 have a pair of bevelled lower surfaces 157, respectively, sloping upwardly convergently toward each other. When the die 31 is moved upwardly toward its uppermost clinching position, the lower surfaces 157 are engageable with the die 51 to pivot the clamp fingers 154 about the pins 155 outwardly away from one another against the force of the leaf springs 156. When the die 31 arrives at the uppermost clinching position, the upper surface of the die 31 lies flush with the upper surface of the holder 150.

The holder 150 further has a vertical bore 158 extending concentrically with and downwardly from the vertical hole 153 for receiving a cylindrical plunger rod 159 to which the die 31 is connected. The bore 158 has a diameter larger than the diameter of the hole 153. The plunger rod 159 is integrally formed with the upper end of a plunger 160 slidably received in a plunger holder 161 secured to the guide block 142. There is a compression coil spring 162 disposed around the plunger rod 159 and acting between the plunger holder 161 and the holder 150 to urge the latter upwardly.

Figure 16:
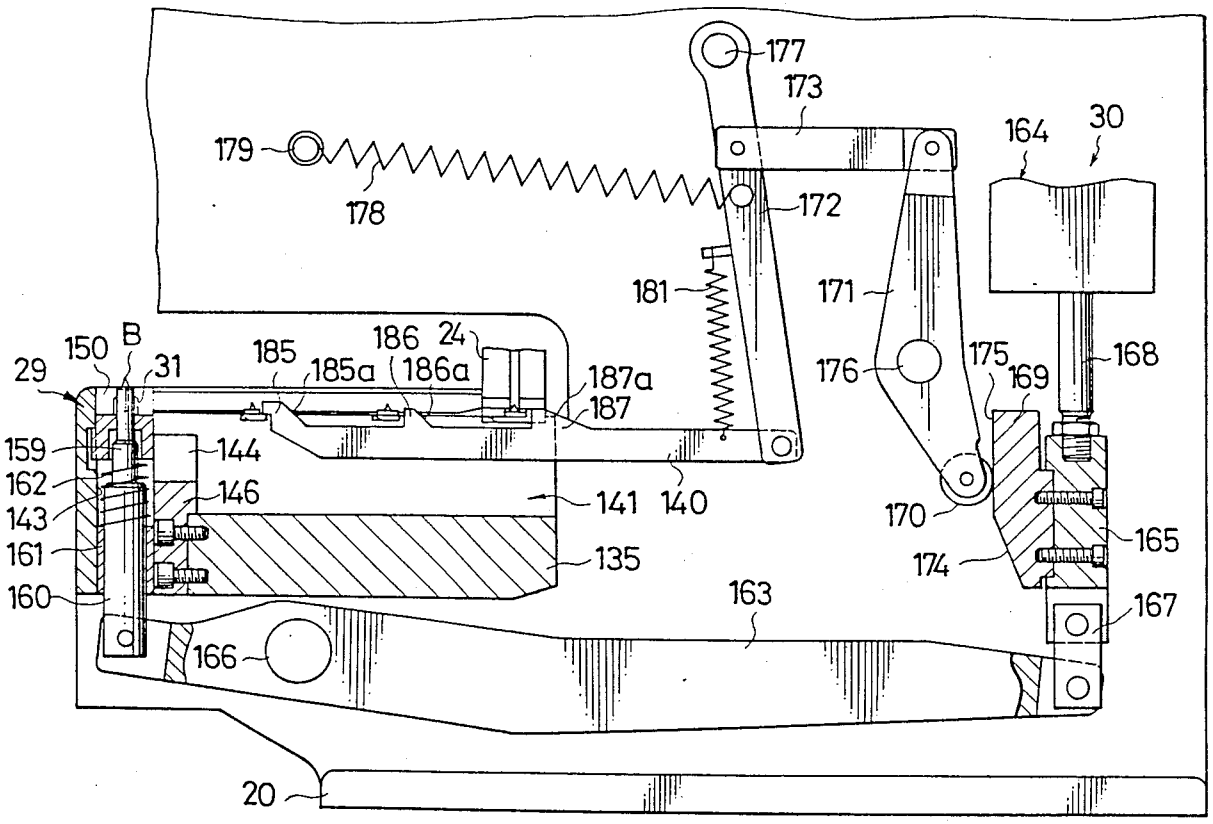

As shown in FIG. 10, the second drive mechanism 30 includes an actuating lever 163, a fluid-pressure actuator such as an air cylinder 164, and a connecting rod 165 operatively interconnecting the actuating lever 163 and the air cylinder 164. The actuating lever 163 is pivotably mounted on the frame 20 by a horizontal shaft 166 secured to the frame 20, and has one end pivotably connected to a lower end of the plunger 160. The other end of the actuating lever 163 is pivotably connected to one end of the connecting rod 165 by a short link lever 167. The other end of the connecting rod 165 is fixedly secured to a piston rod 168 of the air cylinder 164. The air cylinder 164 is fixedly supported on the frame 20 in a vertical disposition. With this construction, when the air cylinder 164 is actuated to extend its piston rod 168, the actuating lever 163 is turned clockwise about the shaft 166 to move the plunger 160 and hence the die 31 toward its uppermost clinching position (FIG. 16). Conversely, retracting movement of the piston rod 168 causes the actuating lever 163 to turn counterclockwise about the shaft 166, thereby lowering the die 31 toward its lowermost standby position (FIG. 10).

The second pusher mechanism 32, as shown in FIG. 10, includes a cam block 169 secured to the connecting rod 165, a cam follower 170 engaging the cam block 169, a pivot lever 171 supporting the cam follower 170, a spring loaded actuating lever 172 linked with the pivot lever 171 by means of a link lever 173, and the lower pusher 140 connected to the actuating lever 172. The cam block 169 has a lower sloping cam surface 174 engageable with the cam follower 170 to cause the pivot lever 171 to turn clockwise, and an upper flat cam surface 175 extending contiguously upwardly from the sloping cam surface 174 and engageable with the cam follower 170 to hold the pivot lever 171 non-rotatably in a tilted position. The cam follower 170 comprises a roller of a resilient material such as rubber and is rotatably mounted on a lower end of the pivot lever 171, the roller follower 170 being normally held in contact with the sloping cam surface 175. The pivot lever 171 is pivoted to the frame 20 by means of a horizontal shaft 176 and is pivotably connected at its upper end to one end of the link lever 173. The opposite end of the link lever 173 is pivotably connected to an intermediate portion of the actuating lever 172. The actuating lever 172 is pivoted at its upper end to the frame 20 by means of a horizontal shaft 177 and has a lower end pivotably connected to a rear end of the lower pusher 140. The actuating lever 172 is urged to turn clockwise about the shaft 177 by means of a tension coil spring 178 extending between a retainer pin 179 secured to the frame 20 and a retainer pin 180 secured to the actuating lever 172. The lower pusher 140 is slidably received in the slit 139 (FIG. 13) and is urged upwardly by a tension coil spring 181 extending between the lower pusher 140 and a retainer pin 182 secured to the actuating lever 172. To hold the lower pusher 140 in horizontal posture, a pair of cover plates 183, 183 (FIGS. 11 and 13) is secured to the respective guide plates 137 to conceal the lower pusher 140. The cover plates 183 jointly define therebetween an interior guide groove 184 opening to the slit 139 for receiving an upper longitudinal portion of the lower pusher 140.

With the second pusher mechanism 32 thus constructed, when the air cylinder 164 is energized to extend its piston rod 168, the roller follower 170 rolls on and along the sloping cam surface 174 on the cam block 169 to thereby turn the pivot lever 171 clockwise (FIG. 10) about the shaft 176. This angular movement of the pivot lever 170 causes the actuating lever 172 to turn counterclockwise about the shaft 177 against the force of the tension spring 178, whereupon the lower pusher 140 is held in its fully retracted position. In response to contraction of the piston rod 168, the roller follower 170 moves from the flat cam surface 175 to the sloping cam surface 174, causing the pivot lever 172 to turn counterclockwise about the shaft 176. This angular movement of the pivot lever 171 causes the actuating lever 172 to turn clockwise about the shaft 177 under the force of the tension spring 178 whereupon the lower pusher 140 is advanced toward the holder 150. The stroke of the lower pusher 140 depends on the length of the sloping cam surface 174 and is independent from the stroke of the piston rod 168. This arrangement is advantageous in applications wherein the garment fabrics C vary in thickness. The stroke of the lower pusher 140 is always constant and any change in thickness of the garment fabrics C is accommodated by the provision of the flat cam surface 175. The lower pusher 140 has on its upper surface a first presser ridge 185 provided at the forward end, a second presser ridge 186 spaced rearwardly from the first presser ridge 185 by a distance equal to the stroke of the lower pusher 140, and a third presser ridge 187 spaced rearwardly from the second presser ridge 186 by the distance or stroke of the pusher 140. Each of the first to third presser ridges 185–186 has a sloping cam surface 185*a*, 186*a*, 187*a* facing rearwardly toward the actuating lever 172.

As shown in FIG. 13, the cover plates 183, 183 have a pair of confronting recessed lower longitudinal edges 188, 188 contiguous to the guide groove 184, the recess 188 and the guide groove 184 jointly defining an elongate feed passage 189 for the tacks B. As seen from FIG. 16, the second chute 24 has a discharge end located adjacent to the third presser ridge 187 when the lower pusher 140 is fully retracted. Stated in other words, the discharge end of the second chute 24 is spaced rearwardly from the third presser ridge 187 by a distance equal to the stroke of the lower pusher 40 when the latter is fully advanced.

The second chute 24, as shown in FIG. 13, includes a lower portion extending from the rear side to the front side of the frame 20 and disposed on the guide plate 137 located near the frame 20. The cover plate 183 disposed on this guide plate 137 is shorter than the other cover plate 183 and has a rear end held in contact with an outer edge of the chute 24 (FIG. 10). The second chute 24 includes a chute body 190 having a longitudinal guide groove 191 defined therein for the passage of the tacks B, and a pair of L-shaped cover plates 192 (only one shown) attached to the chute body 190 to partly close an upper open side of the guide groove 191 for prevent detachment of the tack B from the chute body 190. The chute body 190 is connected to the guide plate 137 through a bracket 193 fastened to the chute body 190 and the guide plate 137. The tack B, as it slides down along the guide groove 191, takes the posture shown in FIG. 2, in which the spike 45 is directed upwardly. The discharge end of the chute 24 has a retaining groove 194 extending transversely to the guide groove 191 for temporarily holding therein the tack B. The retaining groove 194 communicates with the feed passage 189 (FIG. 13). As shown in FIG. 10, the chute body 190 further has a bevelled cam surface 195 engageable with the sloping cam surface 187*a* on the third presser ridge 187 to urge the lower pusher 140 to tilt downwardly into the space 141 (FIG. 13).

Figure 11:
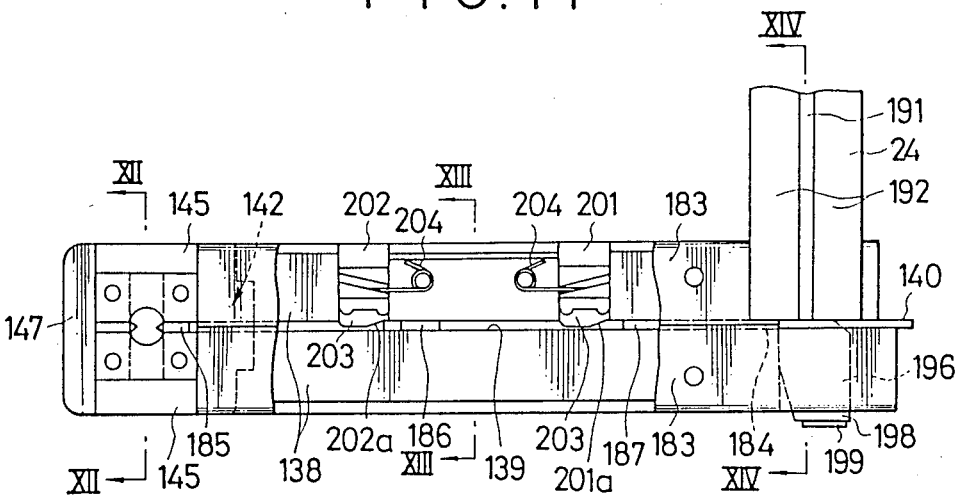
FIG. 11 is an enlarged cross-sectional view taken along line XI—XI of FIG. 1.
Figure 14:
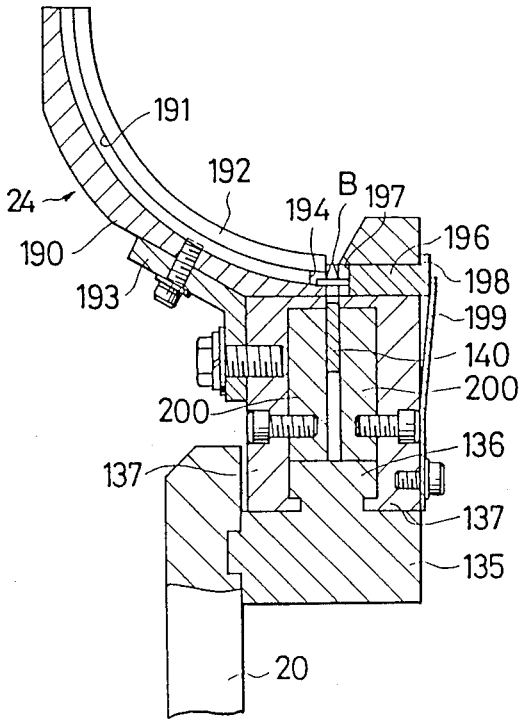
FIG. 14 is a cross-sectional view taken along line XIV—XIV of FIG. 11.

As shown in FIGS. 11 and 14, a retainer finger 196 is slidably supported on the guide plate 137 in confronting relation to the discharge end of the chute 24. The retainer finger 196 has a retaining recess 197 defined in an inner end face thereof and a stop lug 198 projecting upwardly from the rear end of the retainer finger 196. The retaining recess 197 is complementary in contour to the guide groove 191 in the chute 24. The retainer finger 196 is normally urged toward the chute 14 by means of a leaf spring 199 until the stop lug 189 abuts against the guide plate 137. Under such condition, one tack B is stably receivable in the retaining recess 197 in the retainer finger 196 and in the retaining groove 194 in the chute body 190. Although not shown, the retainer finger 196 has a bevelled cam surface engageable with the third presser ridge 187 of the lower pusher 140 to retract the retainer finger 196 against the bias of the leaf spring 199 when the lower pusher 140 is advanced. A pair of parallel spaced retainer plates 200 is fixedly disposed between the guide plates 137 to prevent lateral displacement of the lower pusher 140 while the latter is in motion.

As shown in FIGS. 10 and 11, a pair of first and second retainer arms 201, 202 is slidably mounted in the guide plate 137 disposed close to the frame 20. The first retainer arm 201 is disposed at a position spaced forwardly from the discharge end of the chute 24 by a distance equal to the stroke of the lower pusher 140. Likewise the second retainer arm 202 is spaced forwardly from the first retainer arm 201 by the same distance as the stroke of the lower pusher 140. Each of the retainer arms 201, 202 has a stepped front end 203 and is urged by a torsion spring 204 toward an advanced position in which the stepped front end 203 is party projecting into the slit 139 for temporarily holding one tack B. The first retainer arm 201 has a first cam surface 201*a* (FIG. 11) engageable with the second presser ridge 186 to retract the first retainer arm 201 when the lower pusher 140 is advanced, and a second cam surface 201*b* (FIG. 10) engageable with the cam surface 186*a* on the second presser ridge 186 to tilt the lower pusher 140 downwardly into the space 141 between the guide plates 137 as the lower pusher 140 is retracted. Likewise, the second retainer arm 202 has a first cam surface 202*a* (FIG. 11) engageable with the first presser ridge 185 to retract the second retainer arm 202 when the lower pusher 140 is advanced, and a second cam surface 202*b* (FIG. 10) engageable with the cam surface 185*a* on the first presser ridge 185 to tilt to lower pusher 140 downwardly into the space 141 as the lower pusher 140 is retracted.

With this construction, when the actuating lever 172 is turned counterclockwise in FIG. 10 to retract the lower pusher 140, the cam surfaces 185*a*–187*a* on the first to third presser ridges 185–187 are brought into engagement respectively with the second cam surfaces 202*b*, 201*a* of the retainer arms 202, 201 and the cam surface 195 of the chute 24. This engagement causes the lower pusher 140 to tilt downwardly into the space 141 against the bias of the tension spring 181 so that the respective presser ridges 185–187 can be located rearwardly of the three tacks B held respectively on the stepped front ends 203 of the retainer arms 202, 201 and in a position adjacent to the discharge end of the chute 24. In response to clockwise angular movement of the actuating lever 172, the lower pusher 140 is advanced along a horizontal path, during which time the three tacks B are fed by the first to third presser ridges 185–187 respectively to the holder 150, the second retainer arm 202 and the first retainer arm 201.

The fastener-assembling apparatus of the foregoing construction operates as follows: For purposes of illustration, operation of the apparatus begins from a condition shown in FIGS. 1, 3, 6 and 10 where the piston rods 77, 168 of the air cylinders 72, 164 are fully retracted. Thus, the punch 27 and the die 31 are fully retracted, while the upper and lower pushers 85, 140 are fully advanced so that a button body A is held by the clamp fingers 57 below the punch 27 and a tack B is held on the die 31 by the clamp fingers 154. The position indicator 34 assumes its advanced position and the light beam projected therefrom passes along the common vertical axis of the button body A and the tack B. The light beam produces a light spot on a garment fabric C (FIG. 15) when the later is disposed between the upper and lower units 25, 29.

After a position on the garment fabric C where the button body A and the tack B are to be attached has been set in registry with the light spot, the air cylinders 72, 164 are actuated to extend their piston rods 77, 168.

In immediate response to actuation of the air cylinder 72, and more particularly while the piston rod 77 undertakes a portion of its advancing movement from the cylinder tube 78 adjacent to the fully retracted position, the slide rod 73 and hence the cylinder tube 78 are moved rightwardly in FIG. 3 under the force of the spring 97, thereby causing the pivot lever 79 to turn clockwise about the shaft 80 until the flange 95 on the slide rod 93 engages the block 94. During that time, the shock absorber 38, the first pusher mechanism 28, and the third drive mechanism 33 are put in action.

In response to the forward movement of the piston rod 77, the spring retainer 96 of the shock absorber 38 moves rightwardly away from the block 94 under the force of the spring 97 to cause the slide rod 93 to first engage the piston rod 101 of the dashpot 98 and then to force the piston rod 101 to retract into the dashpot 98. The dashpot 98 controls the motion of the slide rod 93 in such a manner that the flange 95 on the slide rod 93 can be brought into gentle contact with the block 94 without generating objectionable shock noise and vibration. Slightly before the engagement of the flange 95 with the block 94, the cushioning ring 10 engages the bracket 99 to absorb the shock noise and vibration when the spring retainer 96 is brought into engagement with the bracket 99 under the force of the spring 97.

When the pivot lever 79 is turned clockwise about the shaft 80, the presser member 86 of the cushioning rod 81 positively moves the connecting bar 84 leftwardly to thereby turn the actuating lever 82 counterclockwise about the shaft 83. Thus, the upper pusher 85 is retracted from the position of FIG. 3 to the position of FIG. 15 in preparation for feeding of the next succeeding button body A. Subsequent to the beginning of the rearward movement of the upper pusher 85, the actuating lever 82 engages the roller follower 126 (FIG. 6) and then urges the slide bar 123 to retract against the bias of the spring 124. Consequently, the optical position indicator 34 is retracted away from the path of movement of the punch 27. Due to the space provided initially between the actuating lever 82 and the roller follower 126, there is provided a time lag between the movement of upper pusher 85 and the movement of the position indicator 34 with the result that an additional period of time is available for monitoring the position setting of the garment fabric 3 with respect to the path of movement of the punch 27. Furthermore, the position indicator 34 is driven independently from the upper pusher 85 and has a stroke shorter than that of the upper pusher 34. This arrangement is therefore relatively compact and enables a reliable positioning of the garment fabric C without interference with the position indicator 34.

As the piston rod 77 of the air cylinder 72 further advances after the engagement of the flange 95 with the block 94, the toggle joint 73 extends its levers 74, 75 to thereby lower the ram 64 and hence the punch 27. As the holder 54 is frictionally coupled with the ram rod 62 by the split bush 63, the holder 54 is lowered together with the punch 27 until it is brought into abutment with the garment fabric C which is placed over the holder 150 of the lower unit 29. Continuing downward movement of the ram 64 causes the punch 27 to move downwardly through the vertical hole 60 (FIG. 5) in the holder 54 to force the button body A into clinching engagement with the tack B which is forced to drive through the garment fabric C into the button body A as the die 31 is moved upwardly in synchronism with the downward movement of the punch 27. The operation of the lower half of the apparatus will be described later on. When the punch 27 is fully descended as shown in FIG. 15, the locking projection 70 on the retainer hook 65 is vertically downwardly spaced from the abutment 56 of the upper unit 25.

Upon completion of the clinching operation of the button body A and the tack B, the air cylinder 72 is actuated to retract its piston rod 77, whereupon the toggle joint 73 contracts its levers 74, 75 to move the ram 64 and hence the punch 27 upwardly. Due to the resilient force of the split bush 63 acting between the holder 54 and the ram rod 62, the holder 54 moves upwardly along with the punch 27 until the stop shoulders 58 of the holder 54 abut against the lower ends **49*a* of the guide block 46, as shown in FIG. 5. In this instance, the abutment 56 on the holder is hooked on the locking projection 70 of the retainer hook 65 so that the holder 54 is retained in the uppermost element-receiving position in which 54 the space between the clamp fingers 57 is held in alignment with the feed passage 37. With the retainer 34 thus provided, the button body A can be held stably and reliably by the clamp fingers 57**.

Contraction of the toggle joint 73 and hence the upward movement of the punch 27 is limited when the lever engages the stopper member 204. Thereafter, the piston rod 77 of the cylinder 72 is retractable to such an extent that the cylinder tube 78 is pulled toward the toggle joint to turn the pivot lever 79 counterclockwise about the shaft 79 against the force of the spring 79. This angular movement of the pivot lever 79 is terminated when the spring retainer 96 is brought into engagement with the block 94.

In response to the counterclockwise angular movement of the pivot lever 79, the connecting bar 84 is pulled rightwardly while the presser member 86 is held in contact with the connecting bar 84 under the force of the spring 88. Consequently, the actuating lever 82 is turned clockwise about the shaft 82 to move the upper pusher 85 forwardly along the feed passage 37 for supplying the next button body A to the holder 54. In this instance, when the forward movement of the upper pusher 85 is interrupted by a foreign matter jamming the feed passage 37, angular movement of the pivot lever 79 will move the cushioning bar 81 righwardly against the bias of the spring 88 while the connecting bar 84 remains immovable. With this arrangement, the button bodies A can always be protected against damage or deformation even in the presence of a foreign matter in the feed passage 37.

In response to the clockwise angular movement of the actuating lever 82, the slide bar 123 is advanced under the force of the spring 124 until the leg 131 of the retainer block 125 engages the stop bolt 133, thereby displacing the position indicator 34 to the advanced indicating position.

When foreign matter or a button body A is jamming the feed passage 37, the slide block 107 of the gate unit 36 is slid along the guide ridge 108 on the guide plate 106 until the discharge end of the first chute 22 is exposed or at least until the jamming material in the feed passage 37 is exposed. Thus, the jamming material can easily be removed by the operator.

The operation of the lower half of the apparatus is described below with reference to FIGS. 10 and 16.

When the air cylinder 164 is actuated to extend its piston rod 168, the connecting rod 165 and hence the cam block 169 is lowered. Relatively to the downward movement of the cam block 169, the roller follower 170 rolls along the sloping cam surface 174 to turn the pivot lever 171 clockwise about the shaft 176. This angular movement of the pivot lever 171 causes the actuating lever 172 to turn counterclockwise about the shaft 177 against the bias of the spring 178. Consequently, the lower pusher 140 is retracted away from the holder 150. A continuing forward movement of the piston rod 168 causes the roller follower 170 to move from the sloping cam surface 174 to the flat cam surface 175 whereupon the movement of the pivot and actuating levers 171, 172 come to a halt in the respective tilted positions. Accordingly, the lower pusher 140 is posing in the retracted standby position in which the first to third presser ridges 185–187 are located in the feed passage 189 (FIG. 13), immediately upstream of the next succeeding three tacks B respectively retained on the second retainer arm 202, the first retainer arm 201 and the discharge end of the second chute 24.

The forward movement of the piston rod 168 also causes the actuating lever 163 to turn the actuating lever 163 clockwise about the shaft 166 whereupon the plunger 160 and the die 130 are moved upwardly in unison. The pivot point on the actuating lever 163 is located closer to the plunger 160 than to the piston rod 168 so that the die 31 does not interface with the lower pusher 140 while they are in motion. While the upper pusher 140 is kept immovable in the standby position, the die 31 is moved upwardly along the hole 153 (FIG. 12) in the holder 150 to thereby clinch the tack B and the button body A with the garment fabric C sandwiched therebetween.

Thereafter, the air cylinder 164 is actuated to retract its piston rod 168 whereupon the cam block 169 is moved upwardly from the position of FIG. 16 to the position of FIG. 10. During that time, the lower pusher 140 remains immovable until the roller follower 170 moves from the flat cam surface 175 to the sloping cam surface 175, whereupon the pivot lever 171 turns counterclockwise about the shaft 175. This angular movement of the pivot lever 171 permits the actuating lever 172 to turn clockwise about the shaft 177 under the force of the spring 178. Consequently, the lower pusher 140 is advanced horizontally toward the holder 150 to feed the next succeeding three tacks B, respectively, onto the die 31, the second retainer arm 202 and the first retainer arms 201.

Retracting movement of the piston rod 168 also causes the actuating lever 163 to turn counter-clockwise about the shaft 166 to thereby lower the plunger 160 and hence the die 31 to the standby position. As the stroke of the die 31 and the stroke of the lower pusher 140 are independent from one another, a stable clinching operation is preserved even when the button bodies A and the tacks B are to be attached to garment fabrics C of different thicknesses.

Obviously, many modifications and variations of the present invention are possible in the light of the above teachings. It is therefore to be understood that within the scope of the appended claims, the invention may be practiced otherwise than as specifically described.

What is claimed is:

1. An apparatus for assembling a pair of fastener elements of a garment fastener with a garment fabric disposed between the two fastener elements, comprising:

(a) a frame;

(b) a pair of vertically aligned upper and lower units supported by said frame for receiving the respective fastener elements, said upper unit having a punch, said lower unit having a die, said punch and said die being reciprocally movable toward and away from each other to join the two fastener elements together with the garment fabric sandwiched therebetween;

(c) a first drive mechanism for reciprocating said punch, said first drive mechanism including a fluid-pressure actuator having a piston rod and a cylinder tube;

(d) a first pusher mechanism including first means supported by said frame and defining a first feed passage receptive of one fastener element, said first pusher mechanism also including a first pusher reciprocable within said first feed passage to push the one fastener element therethrough to said upper unit;

(e) a second drive mechanism for reciprocating said die;

(f) a second pusher mechanism including second means supported by said frame and defining a second feed passage receptive of the other fastener element, said second pusher mechanism also including a second pusher reciprocable within said second feed passage to push the other fastener element therethrough to said lower unit; and (g) a combined supporting and connecting mechanism for slidably and pivotably supporting said fluid-pressure actuator on said frame and also for operatively connecting said fluid-pressure actuator and said first pusher mechanism, said combined mechanism including a pivot lever rotatably mounted on said frame and pivotably connected at opposite ends with said cylinder tube and said first pusher mechanism, and a spring-biased slide rod slidably mounted on said frame and pivotably connected at its one end to said pivot lever adjacent to said cylinder tube, said slide rod being normally urged in a direction such that during a portion of the movement of said piston rod from said cylinder tube adjacent the fully retracted position of said piston rod, said pivot lever operates said first pusher mechanism to retract and advance said first pusher.

2. An apparatus according to claim 1, said first pusher mechanism further including a cushioning rod pivoted at its one end to the other end of said pivot lever, an actuating lever pivotably supported on said frame and pivoted at its one end to a rear end of said first pusher, a tubular connecting bar pivotably connected at one of its opposite ends to the other end of said actuating lever and loosely receiving said cushioning rod from the other end thereof, a presser member disposed on said cushioning rod and engageable with the other end of said connecting bar, and biasing means disposed in said tubular connecting bar and acting between said connecting bar and said cushioning rod for urging the latter in a direction to keep said presser member in engagement with said other end of said connecting rod.

3. An apparatus according to claim 2, said biasing means comprising a compression coil spring disposed around a longitudinal portion of said cushioning rod which is received in said tubular connecting rod.

4. An apparatus according to claim 1, said spring-biased slide rod including a flange engageable with said frame to limit movement of said slide rod in said direction, further including a shock absorber cooperative with said slide rod to absorb shock noise and vibration when said flange engages said frame.

5. An apparatus according to claim 4, said shock absorber including a dashpot mounted on said frame adjacent to the other end of said slide rod and having a piston rod engageable with said other end of said slide rod prior to the engagement of said flange with said frame.

6. An apparatus according to claim 5, said spring-biased slide rod including an annular spring retainer secured to said other end of said slide rod and having one end engageable with said frame to limit movement of said slide rod in a direction opposite to the first-mentioned direction, and a compression coil spring disposed around said spring retainer and acting between said frame and said spring retainer to urge the latter in said first-mentioned direction, said dashpot being supported on a bracket secured to said frame in confronting relation to the other end of said annular spring retainer, said shock absorber further including a resiliently deformable cushioning ring disposed on said other end of said spring retainer and engageable with said bracket prior to the engagement of said flange with said frame.

7. An apparatus according to claim 1, said first drive mechanism including a reciprocable ram driven by said fluid-pressure actuator and having a ram rod connected to said punch, said upper unit including a tubular holder frictionally retained on said ram rod and movable in unison with said punch during a portion of the stroke of said punch, said holder including means for holding the one fastener element in front of said punch, further including a retainer mechanism incorporated in said ram and lockingly engageable with said holder for retaining said holding means in an element-receiving position when said punch is in an uppermost standby position.

8. An apparatus according to claim 7, said tubular holder having a radially outwardly projecting abutment, said retainer mechanism including a vertically elongate hook pivotably mounted on said ram and having a locking projection disposed below said abutment and lockingly engageable with the latter when said punch arrives at said uppermost standby position, and spring means acting between said ram and said hook for urging the latter to turn in a direction to move said locking projection radially inwardly of said tubular holder.

9. An apparatus according to claim 1, further including a chute supported by said frame for supplying the one fastener element to said first passage, and a gate unit supported on said frame and including a slide block extending along said first feed passage, said slide block being movable in a direction parallel to said first feed passage between a first position in which said slide block is disposed in confronting relation to a discharge end of said chute so as to define therebetween said first feed passage, and a second position in which said slide block is disposed out of confrontation with said discharge end, said slide block being normally held in said first position.

10. An apparatus according to claim 9, said gate unit further including a detent assembly for retaining said slide block in said first and second positions against displacement.

11. An apparatus according to claim 10, said detent assembly including a pair parallel spaced grooves defined in said frame and extending in a direction transverse to said first feed passage, and at least one spring-biased ball mounted in said slide block and snappingly receivable in said grooves.

12. An apparatus according to claim 9, said gate unit further including a knob attached to said slide block.

13. An apparatus according to claim 9, said chute having a retaining recess extending in said discharge end, said guide block having a groove normally facing toward said discharge end of said chute, said gate unit further including a retainer finger slidably mounted in said slide block and having a retaining recess opening toward said retaining recess, and a leaf spring acting between said slide block and said retainer finger to urge the latter toward said discharge end of said chute.

14. An apparatus according to claim 1, further including an optical position indicator movably supported by said frame for indicating a position on the garment fabric where the two fastener elements are to be attached, and a third drive mechanism operatively connected with said position indicator and movable under the control of said first pusher mechanism for reciprocating said position indicator toward and away from the path of movement of said punch in such a manner that retracting movement of said position indicator begins slightly after the start of retracting movement of said first pusher.

15. An apparatus according to claim 14, said third drive mechanism including a slide bar slidably supported on said frame and supporting thereon said position indicator, a follower member carried on said slide bar, and spring means acting between said frame and said slide bar to urge the latter in one direction to advance said position indicator, said first pusher mechanism including an actuating lever pivotably supported on said frame and pivotably connected at its one end to a rear end of said first pusher to reciprocate said first pusher, said actuating lever being normally spaced from said follower member and engageable with the latter to move said slide rod in the opposite direction against the bias of said spring means during pivotal movement of said actuating lever in a direction to retract said first pusher.

16. An apparatus according to claim 1, said second drive mechanism including a fluid-pressure actuator having a piston rod, said second pusher mechanism including a cam block connected to said piston rod of said second drive mechanism, and a pivot lever urged against a cam surface on said cam block and operatively connected to said second pusher for reciprocating the latter in response to the reciprocating movement of said piston rod, said cam surface being profiled such that during a portion of movement of said piston rod from said actuator adjacent the fully retracted position of said piston rod, said cam surface turns said pivot lever to reciprocate said second pusher, while during a portion of movement of said piston rod from said actuator adjacent the fully extended position of said piston rod, said cam surface does not turn said pivot lever to interrupt reciprocating movement of said second pusher.

17. An apparatus according to claim 16, said cam surface including a sloping cam surface and a flat cam surface extending contiguous to said sloping cam surface.

* * * * *